United States Patent [19]

Sparkman

[11] Patent Number: 4,515,317

[45] Date of Patent: May 7, 1985

[54] METHOD OF AND APPARATUS FOR GRINDING SOLID ORGANIC WASTE MATERIAL ENCOUNTERED IN SEWAGE WASTE AND WASTE WATER RECLAMATION

[75] Inventor: David M. Sparkman, Brigham City, Utah

[73] Assignee: Thiokol Corporation, Chicago, Ill.

[21] Appl. No.: 553,201

[22] Filed: Nov. 18, 1983

Related U.S. Application Data

[63] Continuation-in-part of Ser. No. 344,849, Feb. 1, 1982, abandoned.

[51] Int. Cl.[3] ..... B02C 19/06

[52] U.S. Cl. ..... 241/5; 241/39

[58] Field of Search ..... 241/5, 39, 40, 41, 82, 241/79.1, 30, DIG. 38, 19, 21, 1

[56] References Cited

U.S. PATENT DOCUMENTS

| | | | |
|---|---|---|---|
| 2,257,907 | 10/1941 | Griswold | 241/5 X |
| 2,846,151 | 8/1958 | Wehn et al. | 241/39 X |
| 3,058,673 | 10/1962 | Firing | 241/39 |
| 3,326,607 | 6/1967 | Book | 241/39 X |
| 4,018,388 | 4/1977 | Andrews | 241/39 |

*Primary Examiner*—Mark Rosenbaum

*Attorney, Agent, or Firm*—Gerald K. White

[57] ABSTRACT

A method of and apparatus involving an unrestricted gravity feed influent inlet and an unrestricted effluent outlet which is upward and opposed by the force of gravity, for grinding by the slicing action of jet streams of an incompressible fluid such as water, solid waste materials into homogeneous sized bits suitable for pumping and subsequent further processing in a waste treatment system.

5 Claims, 3 Drawing Figures

METHOD OF AND APPARATUS FOR GRINDING SOLID ORGANIC WASTE MATERIAL ENCOUNTERED IN SEWAGE WASTE AND WASTE WATER RECLAMATION

This is a continuation-in-part of application Ser. No. 344,849 filed Feb. 1, 1982 entitled "HIGH PRESSURE HYDRAULIC JET MACERATOR FOR GRINDING SEWAGE AND SIMILAR MATERIALS", now abandoned.

BACKGROUND OF THE INVENTION

1. Field of the Invention

The present invention relates to an improved method of and apparatus for grinding sewage and water separation in marine on-board and small capacity on-land waste treatment systems. The invention has particular utility for macerating solid organic materials that are normally encountered in sewage waste treatment and water reclamation processes. The invention also has useful applications in food processing and in kitchen waste disposal.

2. Description of the Prior Art

Mechanical macerators are known in the prior art for sewage grinding and water separation, commercial forms of such apparatus including hammer mill, roller mill, rotating blade and macerator-pump configurations.

There are certain disadvantages to which mechanical macerators are subject. These disadvantages include limited macerating capacity, particularly of fibrous paper products such as ordinary toilet tissue, a tendency to clogging, and difficulty in cleaning, a clogged rotor sometimes resulting in fingers being cut.

Other forms of apparatus have been proposed in the prior art for grinding materials. Such apparatus, known as fluid energy mills or "micronizers," are used for grinding so-called "friable" materials, that is, materials that are easily crumbled or crushed into a powder, for example, graphite, silica, salt, mica, clay, gypsum, organic pigments and inorganic pigments.

Fluid energy mills generally include a grinding chamber in which jet streams of gaseous fluid are directed in such a manner as to produce a vortex within the chamber, the friable material to be treated being fed or forcibly dispersed into a peripheral region of the chamber, and the action of the jet streams causing the particles to impact and abrade one against another. The larger particles are held in a peripheral region of the chamber by centrifugal force, the finer particles drifting inwardly until they are withdrawn with the milling fluid from a central portion of the grinding chamber. Fluid energy mills of this type are disclosed in the following U.S. Pat. Nos.:

2,257,907 granted Oct. 7, 1941 to N. D. Griswold
2,704,635 granted Mar. 22, 1955 to C. M. Trost
2,846,151 granted Aug. 5, 1958 to J. Wehn et al
2,983,453 granted May 9, 1961 to J. M. Bourquet et al
3,058,673 granted Oct. 19, 1962 to P. C. Firing
3,326,607 granted June 20, 1967 to N. Book
3,425,638 granted Feb. 4, 1969 to C. F. Doyle et al
4,018,388 granted Apr. 19, 1977 to N. H. Andrews A feature common to the structures of each of the above patents is the forcible introduction of the friable material into the grinding chamber through small openings. Aspirating means are employed for this purpose in the Griswold, Trost, Bourquet et al, Firing and Andrews patents. In the Bourquet et al, the Book and the Doyle et al patents similar small openings are also provided for the effluent from the grinding chamber.

U.S. Pat. No. 3,514,043 Slepetys, granted May 26, 1970, discloses another form of fluid energy mill for friable materials comprising a straight tubular milling chamber through which the friable materials are passed, being aspirated thereinto and forced against the cylindrical inner wall of the chamber by a deflecting shield positioned immediately adjacent the entrance thereof. Milling fluid is introduced at high velocity into the chamber through jet apertures that are distributed along the length of the chamber. The effect of the high velocity streams from the jet apertures is stated to be one of subjecting the friable material to such violent action that the individual particles are thrown into contact with the chamber wall and with each other, and thus are broken up.

A problem common to the fluid energy mills for friable materials of all of the above-mentioned patents, a problem which renders such mills unsatisfactory for use in grinding solid organic waste material encountered in sewage waste and waste water reclamation is the use therein, in each case, of small holes or restricted passages through which the material to be ground must pass and which would tend to become clogged if the mill were employed to grind solid organic sewage waste.

Another problem common to many of the prior art fluid energy mills which render them unsuitable for use in grinding solid organic waste material, a problem typified by the Griswold process and device, is the use therein of a gaseous fluid medium for effecting particle impact one against another and abrading thereof. In the Griswold device a heated gas is injected into a cylindrical swirl chamber with both tangential and transverse components of motion. The Griswold device is capable only of grinding hard, abrasive materials since it does so by inducing continual collisions between particles. The centrifugal force inherent in a spin chamber is used in the Griswold device as the primary means of retaining the particles in the chamber until particle size reduction has been achieved by the abrasion of the continual collisions with each other as caused by the gas jets.

A device known in the prior art as useful for liquid-solids separation is the hydrocyclone separator, also known as Dreissen cones or Dutch State Mines cyclones. The hydrocyclone is a centrifugal filter or inertial separator wherein the influent is fed at a high velocity tangentially into a forced vortex chamber having a cylindrical upper section and a conical lower section. As the fluid spirals downward in the conical section, the radius of curvature decreases, thus creating an acceleration of several thousand G's and an accompanying centrifugal force. At the same time, the fluid is subjected to an opposing inward radial force due to the stoke's drag of the inwardly moving fluid. The effects of these combined forces tend to separate and classify particles within the fluid as a function of individual densities. Heavier particles are held near the walls and are removed as underflow, while the lighter materials are concentrated near the center of the vortex and are removed with the overflow.

The hydrocyclone separation has been successfully used in conjunction with heavy-medium suspensions for effecting separation of heavy minerals in fine sizes, but its efficiency is unacceptably poor for separating solids and related waste materials found in raw sewage. Thus, in a test of a commercially available hydrocyclone separator normally used as a sand and metal chip degritter in oil and lubrication systems, where the test medium was a concentrated solution of finely macerated toilet tissue paper, the actual separation ratio was found to be only 60-40. This poor separation ratio was attributed to the specific gravity of the saturated paper material approaching a value of 1.

In a demonstration of another form of hydrocyclone separator involving the use of a closed pot and a contamination trap and using clay as a contaminant, clay was effectively removed but the contamination trap required hand cleaning after each run. Previous tests with raw sewage had caused severe clogging of the contamination trap filter.

There thus exists a need and a demand in the art for an improved method of and apparatus for the grinding of raw sewage and water separation. The present invention was devised to fill the technological gap that exists in the art for equipment of this type, particularly in marine on-board and small capacity on-land waste treatment systems.

SUMMARY OF THE INVENTION

An object of the invention is to provide an improved method for grinding solid organic waste material encountered in sewage waste treatment and waste water reclamation into homogeneous sized bits suitable for pumping and further processing in a waste treatment system.

Another object of the invention is to provide a high pressure hydraulic macerator for grinding solid organic waste material into homogeneous bits that are suitable for pumping and subsequent further processing in a waste treatment system.

A further object of the invention is to provide such a macerator having particular utility in marine on-board and small capacity on-land waste treatment systems.

A specific object of the invention is to provide a macerator for the grinding of sewage waste and other similar materials having no knives, hammers or other mechanically movable parts, and in which there are no screens, small holes or restricted flow passages which could tend to become clogged.

In accomplishing these and other objectives of the present invention, there is provided a shallow cylindrical grinding chamber wherein tangentially directed high pressure jet streams of imcompressible fluid provided at the periphery of the chamber produce a vortex, the influent containing water and the material to be macerated entering, unrestricted and under the force of gravity only, the central or low pressure area of the vortex and being drawn into and swept up into the swirling stream. As the material spins in the cylindrical chamber, it is repeatedly passed through the jet streams of incompressible fluid and is cut into progressively smaller bits or particles by the slicing action of the jet streams. Finished particle size delivered against the force of gravity to an upwardly positioned unrestricted effluent discharge outlet is independent of the flow outlet size, and is a function of a balance between chamber fluid velocity and the largest dimension of the particle. This effect is caused by the towing or dragging action created by laminar flow frictional forces acting along the length of the particle and tending to grip the particle in the swirling stream. As the largest dimension, or length, of the particle diminishes, total frictional force from the swirling action decreases until the particle is finally released into the effluent discharge outlet. Thus, particle size can be varied and controlled by regulating the chamber fluid velocity.

The apparatus of the present invention is capable of grinding or macerating soft, pliable materials such as are found in solid organic sewage waste material and does so through the slicing and tearing apart of the material by the momentum of high velocity incompressible fluid, or water, molecules impacting directly on the material being processed.

This method of grinding is in sharp contrast with that employed in the prior art fluid energy mills typified by the Griswold patent discussed hereinbefore, wherein grinding of hard, abrasive materials only is possible because the grinding is effected by inducing continual collisions between particles.

Additionally, according to the method and apparatus of the present invention, centrifugal force in the spin chamber is used only to hold the material being processed near the outer periphery of the cylindrical chamber so that the material is repeatedly passed directly through the jet streams or cutters of incompressible fluid and is cut up into progressively smaller bits or particles as the material is towed around the chamber by the laminar drag of the particles in the flow stream of incompressible fluid until such time as the particle surface area has been reduced to the point where frictional drag forces are at or below molecular adhesion forces which tend to bind the particles of smaller surface area to the effluent flow.

Again, this method of grinding is in sharp contrast with that employed in the prior art energy mills such as disclosed by the Griswold patent wherein the centrifugal force inherent in a spin chamber is used as the primary means of retaining the particles in the chamber until desired particle size reduction has been achieved by abrasion of the continual collisions with each other as caused by the gas jets.

The maceration of soft non-abrasive materials according to the present invention is made possible by the use of high velocity jets of incompressible fluid such as water instead of gaseous fluid jets as used in the prior art energy mills. The much higher weight density of water, for example, which is 860 times greater than a typical ideal gas under standard conditions, results in a proportionally higher momentum at impact with the material being processed, and thus supplies the cutting and tearing force which is needed to macerate pliable materials.

The method of controlling the delivered particle size in the prior art energy mills, as typified by the device of the Griswold patent, is the regulation of the gas exit velocity. The particles are reduced in mass density at a faster rate than they are reduced in surface area. Thus, when the effect of wind resistance acting on the surface area results in a force greater than the centrifugal and gravitational forces acting on the particle, the particle is swept toward the center of the vortex in the chamber by the exiting gas. The particle exits the chamber at the center of the vortex where centrifugal force is near zero.

In accordance with the present invention, the delivered particle size is controlled by the velocity of the swirl stream in the spin chamber. The particles are retained in the swirl stream by laminar frictional drag forces. Frictional drag is due to the viscosity of the fluid. It is the force produced by the viscous shear in the layers of the fluid immediately adjacent to the particle body. It is always proportional to the wetted area of the body. Since the dynamic viscosity of water is more than 64 times greater than the viscosity of a typical gas, it becomes apparent that the operating principle of the present invention is heavily dependent on the fluid mechanics of a liquid as opposed to a gaseous medium such as is used in the prior art energy mills.

Because of the dissimilar principles involved, the direction of influent-to-effluent flow is necessarily opposite in the apparatus of the present invention and that of the prior art energy mills as typified by the Griswold patent. Thus, in the apparatus of the present invention, influent is introduced in the lower pressure region at the center of the vortex and exits in the higher pressure region near the periphery of the cylindrical chamber. This method and apparatus is characterized in that it does not require influent injection under pressure as in the prior art devices.

Further, in accordance with the invention, as an optional hydraulic macerator accessory, a self-flushing tramp metal collector is provided for the removal of razor blades, nuts, bolts, etc. which may occasionally enter the system inadvertently. The metal collector is attached to the bottom of the cylindrical grinding chamber of the macerator, and resembles an open topped milk bottle. The self-flushing action is effected by positioning the cylindrical mouth of the bottle such that differential linear velocities flowing across the mouth create a mini-whirlpool inside the bottle. Lighter materials collected are forced into the vortex of the whirlpool and are carried upward out of the bottle. The lower section of the bottle is provided with baffles and small magnets for retention of metal objects.

Other objects and advantages will become apparent from the following detailed description and the accompanying drawings.

DESCRIPTION OF THE PREFERRED EMBODIMENT

Figure 1:
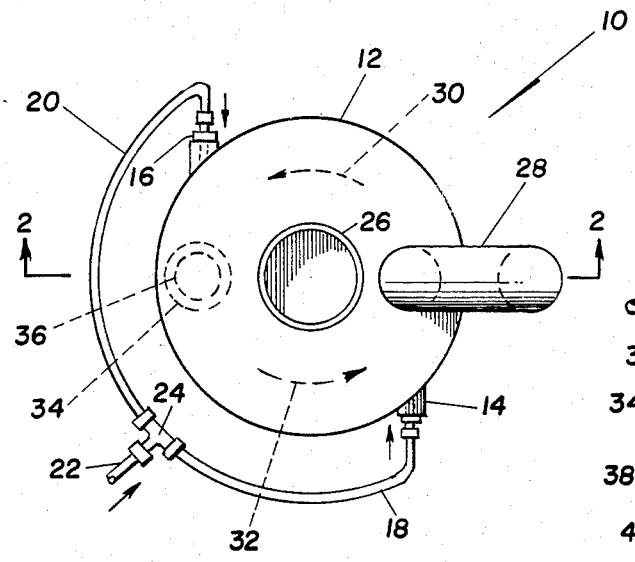
FIG. 1 is a top plan view of the hydraulic jet macerator of the present invention.
Figure 2:
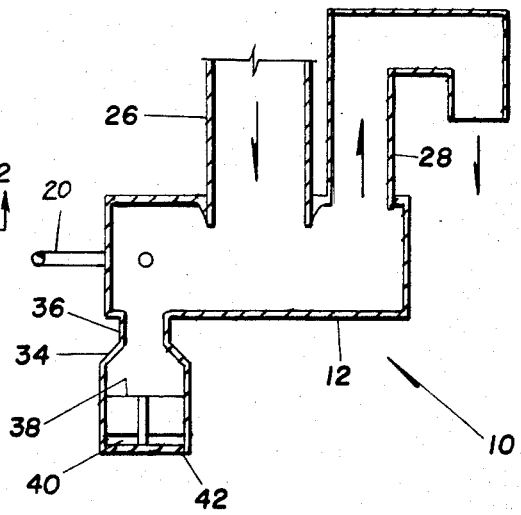
FIG. 2 is cross-sectional view in side elevation taken along the lines 2—2 in FIG. 1.

Referring now to the drawings there is illustrated in the drawings a high pressure hydraulic jet macerator 10 for grinding sewage waste and other similar materials. The hydraulic jet macerator 10 comprises a cylindrical grinding chamber 12, tangentially directed high pressure jets 14 and 16, conduits 18, 20 and 22, a three-way conduit connector 24, a centrally located influent inlet 26, an effluent discharge outlet 28, and a tramp metal collector 34 located in the bottom of chamber 12. The axis of cylindrical chamber 12, as shown, is oriented in a vertical direction, inlet 26 and outlet 28 being located in the top of the chamber 12.

A source, not shown, of an incompressible fluid such as water at high pressure, specifically 1,000 p.s.i.a. in the preferred embodiment of the invention, is connected by conduit 22, connector 24 to each of the conduits 18 and 20, conduit 18 being connected to jet 14 and conduit 20 being connected to jet 16. Jets 14 and 16 are tangentially oriented in aiding relation on diametrically opposite sides of the periphery of the grinding chamber 12 with no transverse components of motion. With the jets 14 and 16 so oriented and connected to the high pressure source of water, the resulting jet streams within the chamber 12 cooperate to produce a whirling mass of water or vortex moving counter-clockwise around the cylindrical chamber, as indicated by the dotted lines 30 and 32 in FIG. 1. The pressure of the region at the center of the vortex is substantially lower than atmospheric pressure.

Figure 3:
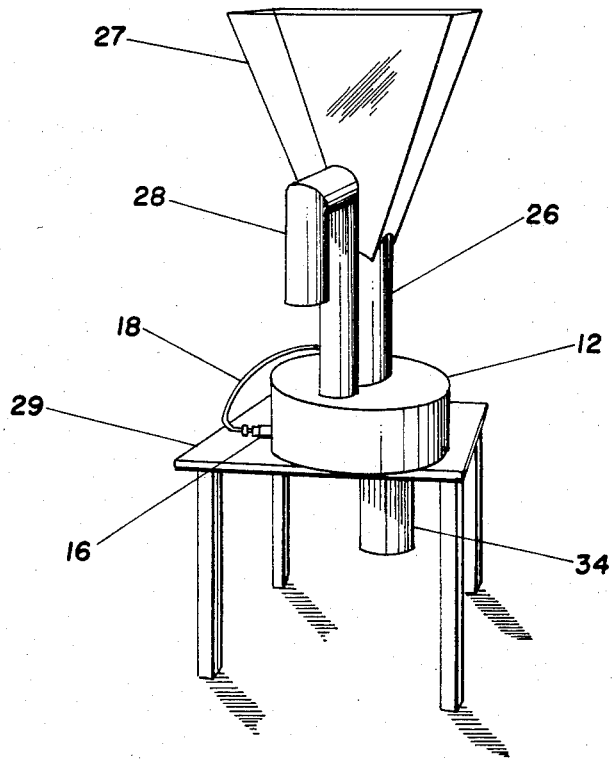
FIG. 3 is a perspective view of the hydraulic jet macerator mounted on a table.

Influent containing the sewage waste or other material to be ground enters inlet 26 under the force of gravity only from a hopper or other container indicated at 27 in FIG. 3 that is disposed above the macerator 10, the hydraulic jet macerator 10 in FIG. 3 being shown mounted on a table 29. Inlet 26 is located immediately above the low pressure vortex region within chamber 12, and as a result, the influent is drawn and swept into the swirling stream. As the material is whirled around the cylindrical chamber 12, it is repeatedly passed through the jet streams and cut into progressively smaller bits by the slicing action of the jet streams.

The size of the bits or particles before being delivered by the macerator 10 to the effluent discharge outlet is a function of a balance between chamber fluid velocity and the largest dimension of the particle. This is due to the towing action created by laminar friction flow frictional forces acting along the length of the particle and tending to grip the particle in the swirling stream. As the largest dimension, or length, of the particle diminishes, total frictional forces from the swirl action decreases until the particle is finally released into the effluent discharge outlet. Accordingly, particle size can be varied and controlled by regulating chamber fluid velocity.

A self-flushing tramp metal collector as indicated at 34 may be provided for the removal of razor blades, nuts, bolts, etc. that occasionally may enter the system inadvertently. The metal collector 34 is attached to the bottom of the cylindrical chamber 12 adjacent the periphery thereof at a position diametrically opposite the effluent outlet 28. Collector 34 resembles an open-topped milk bottle. The self-flushing action is effected by positioning the cylindrical mouth of the bottle such that differential linear velocities flowing across the mouth create a mini-whirlpool inside the bottle. Lighter materials collected are forced into the vortex of the whirlpool and are carried upwards out of the bottle. The lower section of the bottle is provided with baffles indicated at 38 and small magnets indicated at 40 for the retention of metal objects. A closure cap as indicated at 42 may be provided for facilitating the periodic emptying of the collector 34 of objects collected therein.

A full size 20 GPM (gallons per minute) high pressure hydraulic jet macerator 10 according to the invention was subjected to rigorous testing. Test results were excellent. Various test media were employed including toilet tissue, paper towels, sanitary napkins, rags, paper cups, cardboard, cigarette tips, lettuce, celery, hot dogs, corn shucks, human hair, etc. Concurrent with these tests of the hydraulic jet macerator, comparative evaluation tests were made on four different types of commercially available mechanical macerators. These included hammer mill, rotating blade, and macerator pump configurations. In each case macerator performance fell far short when compared to the performance of the hydraulic jet macerator.

Specifically, it was found that the tested 20 GPM hydraulic jet macerator 10 was capable of grinding up to 250 grams per minute, dry weight, of the most difficult materials expected to be encountered in waste disposal systems. This amount is equivalent to one full roll of toilet tissue or 230 wet strength paper towels macerated per minute. Fibrous materials such as corn shucks and human hair were macerated successfully, but required more time. Ordinary cotton cloth rags were shredded, again at a much reduced rate. Razor blades, nuts and bolts, and other tramp metal objects were successfully caught and held in the tramp metal collector, with no ill effects to the macerator. Up to the flow rate and solids influent rate indicated, no clogging or material buildup occurred.

The hydraulic jet macerator 10 requires a continuous 4 GPM clean water flow at 1,000 p.s.i. for jet operation. This flow is normally supplied from a 3 HP pump, not shown.

Thus, there has been provided, according to the invention, an improved method and apparatus for grinding solid waste materials into homogeneous bits suitable for pumping and subsequent further processing in a waste treatment system. In the embodiment of the invention that is illustrated and described herein, the hydraulic jet macerator 10 includes a cylindrical chamber 12 having its axis oriented in a generally vertical direction and wherein high pressure jet streams of an incompressible fluid such as water produce a vortex. Influent containing water and the material to be macerated enters through the influent inlet 26, unrestricted, the central or low pressure area of the vortex and is drawn and swept up into the stream swirling within the chamber 12. Repeated movement of the material to be macerated through the jet streams results in the material being sliced into progressively smaller particles or bits. The bits of material are delivered against the force of gravity, when of such a small size as to be released from the swirling fluid, to an upward, unrestricted discharge outlet located adjacent the periphery of the chamber 12. By regulating the chamber fluid velocity, the particle size can be varied and controlled.

The hydraulic jet macerator 10 is relatively insensitive to influent flow variations within the maximum flow capability for a particular size unit. This feature evolves from the capability of the unit to release free water (or other liquid) at the same rate as received, retaining only the solid matter within the chamber. Free water does not degradate the maceration process.

The hydraulic jet macerator 10 is directly scalable to large or small sizes, and jet pressure may be varied upward or downward as required by a particular application.

There has also been provided, according to the invention, a self-flushing tramp metal collector 34 that is attached to the bottom of the chamber 12 at a peripheral region 36 that is diametrically opposite to the effluent outlet 26 and which includes baffles 38 and magnets 40 for the retention of metal objects.

What is claimed is:

1. A process for grinding solid organic waste material encountered in sewage waste treatment and waste water reclamation into homogeneous sized particles suitable for pumping and further processing in a waste treatment system comprising, tangentially injecting into a shallow cylindrical processing zone at a plurality of positions spaced around the periphery thereof jet streams of incompressible fluid thereby to form within the processing zone a substantially planar fluid vortex having a low pressure region at the center thereof, the axis of the cylindrical processing zone being disposed in a generally vertical direction and being substantially coincident with the center of the vortex, introducing under the force of gravity only influent containing solid waste material to be ground into the low pressure region of the vortex thereby to cause the waste material to be drawn and swept up into the vortex and spun around the cylindrical processing zone and to allow centrifugal force to force the waste material to the peripheral region of the processing zone so that the waste material is repeatedly passed directly through the jet streams of fluid and is cut up into progressively smaller particles as the waste material is towed around the chamber by laminar frictional drag of the waste material in the flow stream of the vortex until the surface areas of the particles of waste material are reduced to a size such that frictional drag forces are at or below molecular adhesion forces which tend to bind the particles of waste material to the flow stream of the vortex, and discharging against the force of gravity from a peripheral region of the cylindrical processing zone, in a fluid suspension, particles of waste material having surface areas of such reduced size.

2. A process for grinding solid organic waste material encountered in sewage waste treatment and waste water reclamation into homogeneous sized bits suitable for pumping and further processing in a waste treatment system comprising, tangentially injecting into a shallow cylindrical chamber at a plurality of positions spaced around the periphery thereof jet streams of water thereby to form within the chamber a substantially planar vortex having a low pressure region at the center thereof, the axis of the chamber being disposed in a generally vertical direction and being substantially coincident with the center of the vortex, introducing under the force of gravity only influent containing water and solid waste material to be ground into the low pressure region of the vortex thereby to cause the waste material to be drawn and swept up into the vortex and spun around the chamber and to allow centrifugal force to force the waste material to the peripheral region of the chamber so that the waste material is repeatedly passed directly through the jet streams of water and is cut up into progressively smaller bits as the waste material is towed around the peripheral region of the chamber by laminar frictional drag of the waste material in the flow stream of the vortex until the surface areas of the bits of waste material are reduced to a size such that frictional drag forces are at or below molecular adhesion forces which tend to bind the bits of waste material to the flow stream of the vortex, and discharging against the force of gravity from a peripheral region of the chamber, in a water suspension, bits of waste material having surface areas of such reduced size.

3. Apparatus for grinding solid organic waste material encountered in sewage waste treatment and waste water reclamation into homogeneous sized bits suitable for pumping and further processing in a waste treatment system comprising, means forming a shallow cylindrical chamber the axis of which is oriented in a vertical direction, tangential jet forming means positioned at a plurality of positions around the periphery of said chamber for introducing tangential streams of incompressible fluid into said chamber thereby to form within the chamber a whirling flow of fluid constituting a substantially planar vortex having a low pressure region at the center thereof, the center of said vortex coinciding substantially with the axis of said chamber, means for introducing under the force of gravity only influent containing solid waste material to be ground into the low pressure region of the vortex thereby to cause the waste material to be drawn and swept up into the vortex and spun around the cylindrical chamber and to allow centrifugal force to force the waste material to the peripheral region of the chamber so that the waste material is repeatedly passed directly through the jet streams of fluid and is cut up into progressively smaller bits as the waste material is towed around the peripheral region of the chamber by laminar frictional drag of the waste material in the flow stream of the vortex until the surface areas of the bits of waste material are reduced to a size such that frictional drag forces are at or below molecular adhesion forces which tend to bind the bits of waste material to the flow stream of the vortex, and means for discharging against the force of gravity from a peripheral region of the cylindrical chamber, in a fluid suspension, bits of waste material having surface areas of such reduced size.

4. Apparatus as defined in claim 3 wherein said tangential jet forming means includes a first jet nozzle on one side of the axis of said chamber and a second jet nozzle diametrically displaced from said first jet nozzle, with the jet streams issuing from the first and second jet nozzles being in aiding relation and having no transverse components of motion, wherein the incompressible fluid is water, and wherein the influent containing solid waste material to be ground is water.

5. Apparatus as defined in claim 4 wherein said means for introducing waste material into the low pressure region of the vortex are disposed above the chamber, and wherein said means for discharging processed bits of waste material in fluid suspension are connected to an upper portion of said chamber.

* * * * *